United States Patent [19]

Odean

[11] Patent Number: 5,033,796

[45] Date of Patent: Jul. 23, 1991

[54] SAFETY BLADE GRIPPING ASSEMBLY FOR POWER OPERATED FLOOR STRIPPER

[75] Inventor: M. Barry Odean, Palmdale, Calif.

[73] Assignee: Grasse Family Trust, Glendale, Calif.

[21] Appl. No.: 516,789

[22] Filed: Apr. 30, 1990

[51] Int. Cl.[5] ..... A47L 11/12

[52] U.S. Cl. ..... 299/37; 15/93.1; 30/169; 411/367

[58] Field of Search ..... 299/24, 37; 30/169, 30/170; 15/93.1; 403/3, 4, 18, 20, 299, 343; 411/367

[56] References Cited

U.S. PATENT DOCUMENTS

| | | | |
|---|---|---|---|
| 892,634 | 7/1908 | Whitmore | 30/170 |
| 2,636,529 | 4/1953 | Miltenberg | 30/169 X |
| 4,088,369 | 5/1978 | Prater | 30/170 X |
| 4,254,542 | 3/1981 | Craig | 403/408.1 X |
| 4,286,383 | 9/1981 | Farden | 299/37 X |
| 4,365,842 | 12/1982 | Grasse | 299/37 |
| 4,365,843 | 12/1982 | Grasse | 30/169 X |
| 4,452,492 | 6/1984 | Grasse | 299/37 |
| 4,483,566 | 11/1984 | Grasse | 299/37 |
| 4,504,093 | 3/1985 | Grasse | 299/37 |
| 4,598,476 | 7/1986 | Grasse | 30/169 |
| 4,669,784 | 6/1987 | Grasse | 299/37 |

*Primary Examiner*—Ramon S. Britts
*Assistant Examiner*—David J. Bagnell
*Attorney, Agent, or Firm*—William W. Haefliger

[57] ABSTRACT

A power-operated, floor stripping apparatus includes a frame, a drive carried on the frame, wheels supporting the frame, a handle to guide the frame, and a cutter blade carried by a head which is pivotally mounted to the frame. The head has a lower end to face toward the floor; upper and lower plates carried by the head at the lower end thereof to grip the cutter blade received therebetween; two posts carried by the lower plate to project upwardly through openings formed in the upper plate, and sleeves extending about the posts above the upper plate, the posts carrying exposed threads; and nut members threadably attached to the posts and having wrench surfaces spaced substantially above the level of the blade, the nuts tightenable to transmit upward force in the posts and downward force to the sleeves, whereby the plates are caused to grip the blade therebetween, the blade having a cutting edge directed forwardly.

12 Claims, 4 Drawing Sheets

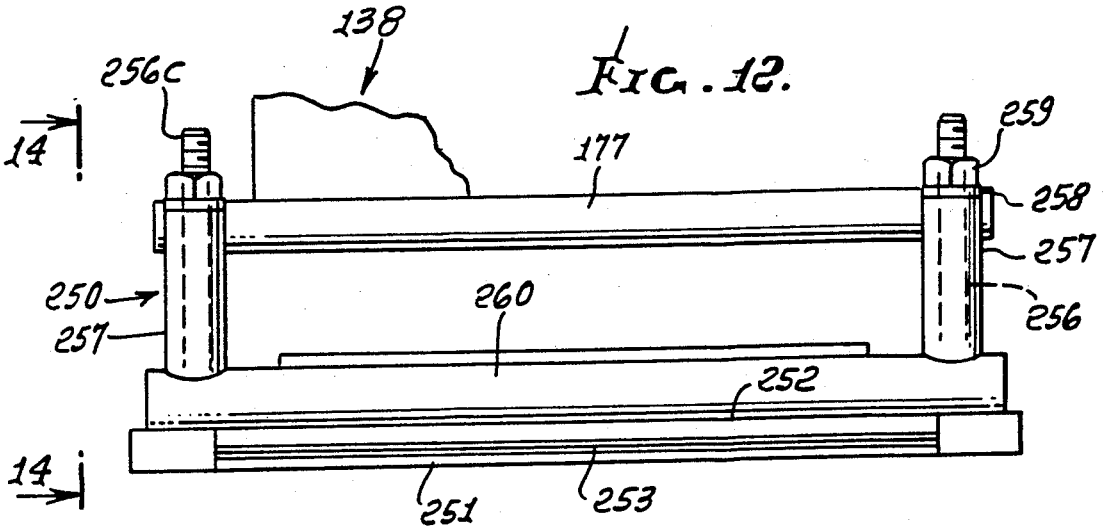
FIG. 12.
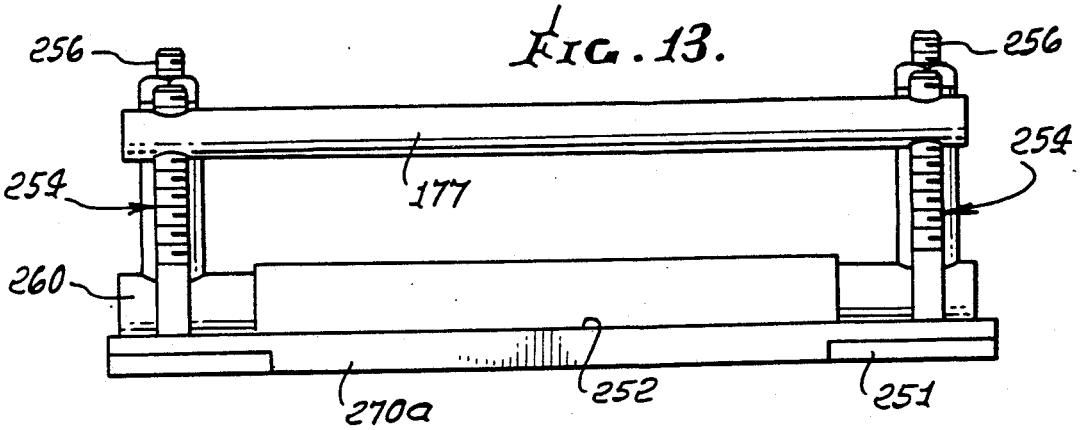
FIG. 13.
FIG. 14.
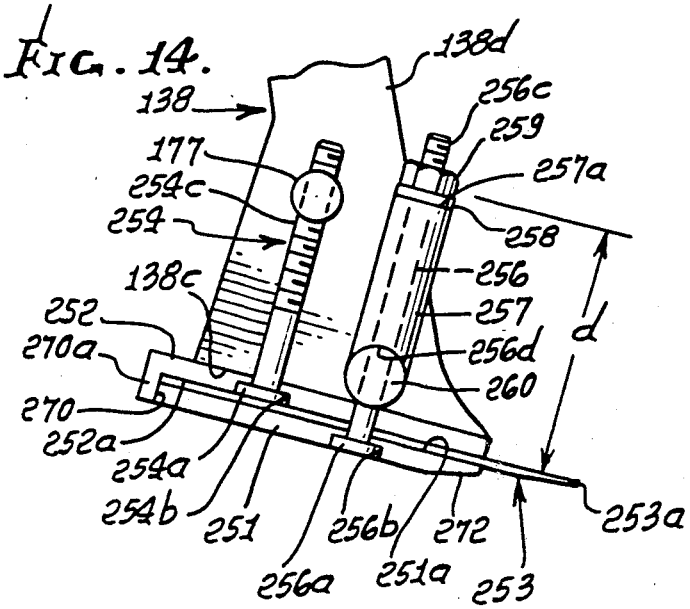
FIG. 15.
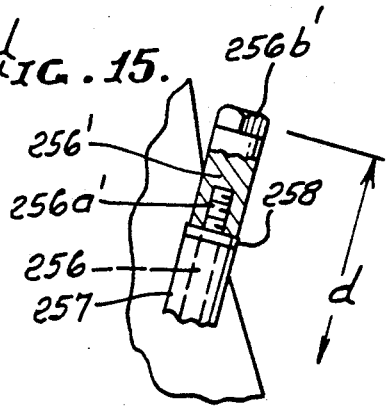

SAFETY BLADE GRIPPING ASSEMBLY FOR POWER OPERATED FLOOR STRIPPER

BACKGROUND OF THE INVENTION

This invention relates generally to floor stripping devices, and more particularly concerns improvements in the driving and blade support means for same.

U.S. Pat. Nos. 4,669,784; 4,598,476; 4,512,611; 4,504,093; 4,483,566; 4,452,492; 4,365,843; and 4,365,842 disclose a floor stripping machine of the type in which the present invention is usable to great advantage. Such machine incorporates a cutting blade carried by a head pivotally mounted to a frame. Problems with machines, as disclosed in such patents, include wear of the blade mounting head, incorrect positioning of the cutter blades, unwarranted high cost of repair and replacement of such elements, and difficulty with clamping a blade to the bottom side of the head. Mounting and changing of the cutter blades, in a safe manner, is another problem.

SUMMARY OF THE INVENTION

It is a major object of the invention to provide a solution to the above-described problems. Basically, the invention is embodied in a power-operated, floor stripping apparatus that includes a frame, a drive carried on the frame, wheels supporting the frame, a handle to guide the frame, and a cutter blade carried by a head which is pivotally mounted to the frame. The improvement of the invention comprises:

a) the head having a lower end to face toward the floor, b) upper and lower plates carried by the head at the lower end thereof to grip the cutter blade received therebetween, c) two posts carried by the lower plate to project upwardly through openings formed in the upper plate, and sleeves extending about the posts above the upper plate, the posts carrying exposed threads, d) and nut members threadably attached to the posts and having wrench surfaces spaced substantially above the level of the blade, the nuts tightenable to transmit upward force in the posts and downward force to the sleeves, whereby the plates are caused to grip the blade therebetween, the blade having a cutting edge directly forwardly, well below the nut wrench surfaces.

As will appear, the nut wrench surfaces are typically spaced at least about two to three inches above blade level; and a blade stop shoulder is attached to one of the plates at the rearward end thereof. Further, the lower plate typically has a bevel at the forwardmost underside thereof, the bevel tapering forwardly, and upwardly toward the underside of the cutter blade, to minimize interference by the lower plate with blade scraping or stripping action.

Additionally, the head may consist of lightweight metal and have two flanges interconnected by a web, the flanges being locally thickened to substantial extent to define the two lugs forming bearing openings for a pivot shaft connected to the frame; and there being two shafts extending parallel to the head web and through the head flanges to provide shaft projections exteriorly of the flanges, and fasteners extending upwardly from the upper plate and having threaded shanks in threaded engagement with threaded openings in the shaft projections.

These and other objects and advantages of the invention, as well as the details of an illustrative embodiment, will be more fully understood from the following specification and drawings, in which:

DRAWING DESCRIPTION

Figure 11:
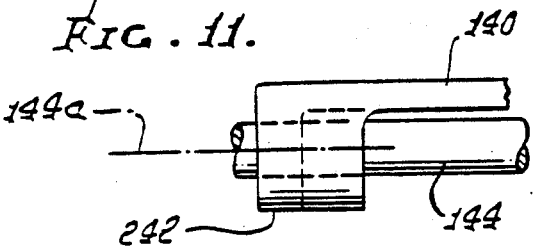
FIG. 11 is a fragmentary plan view on lines 11–11 of FIG. 8.
Figure 11A:
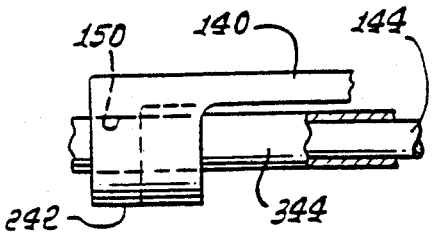

FIG. 11*a* is a view like FIG. 11;

FIG. 12 is a front elevation showing a further modified blade holding or gripping assembly;

FIG. 13 is a rear elevation of the FIG. 12 assembly;

FIG. 14 is a section taken on lines 14–14 of FIG. 12; and

FIG. 15 is a fragmentary view similar to FIG. 14 but showing a modification.

DETAILED DESCRIPTION

Figure 1:
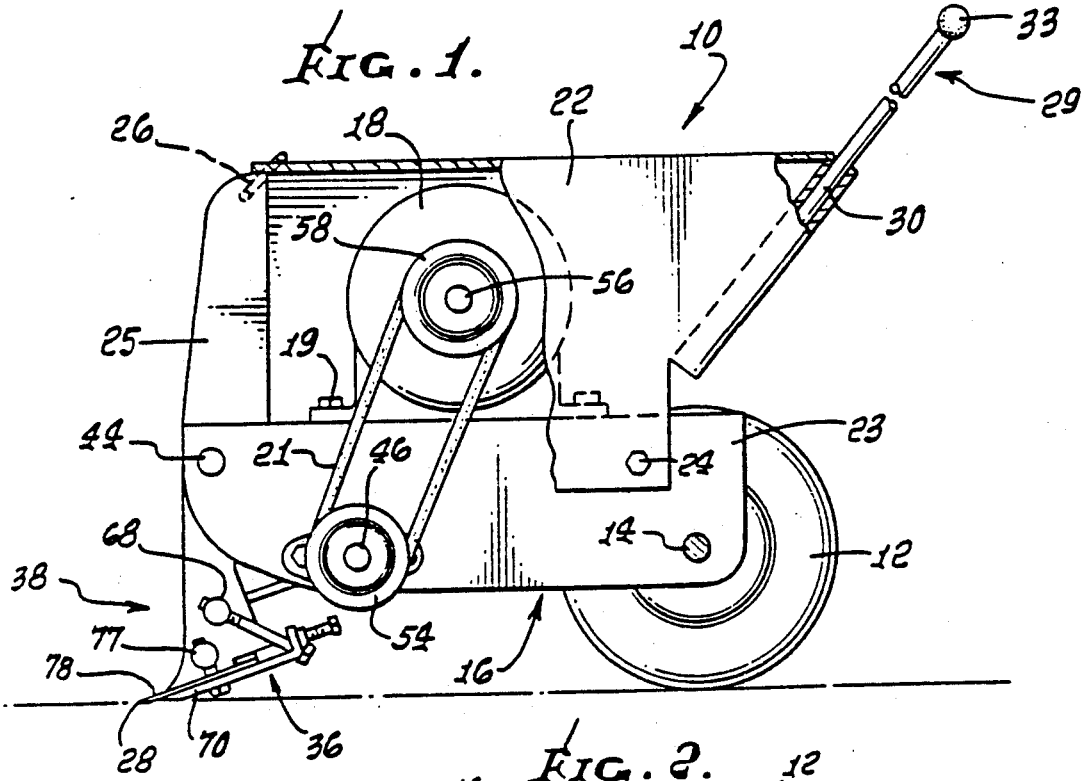
FIG. 1 is a side elevation showing a floor stripping machine incorporating the invention.
Figure 2:
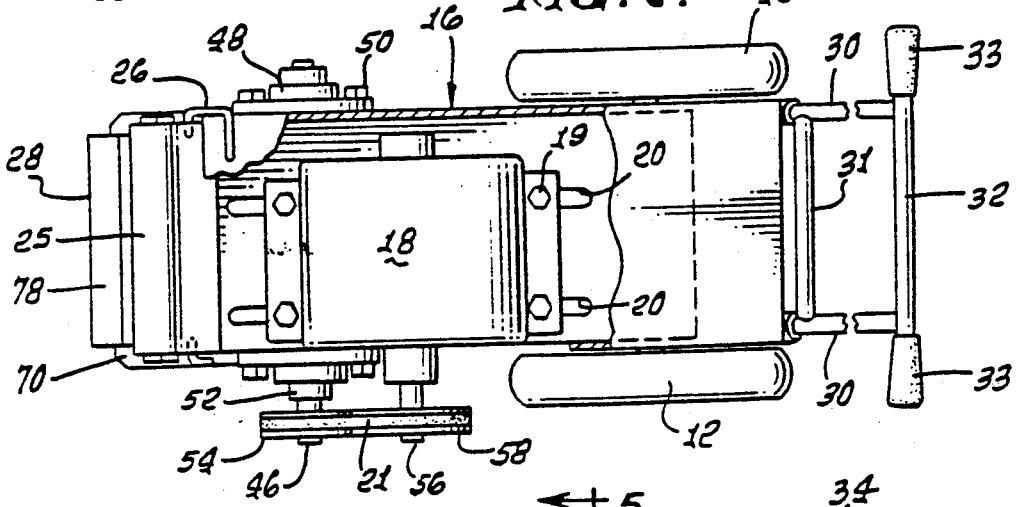
FIG. 2 is a top plan view of the FIG. 1 machine.

Referring now to the drawings and initially to FIGS. 1 and 2, inclusive, for this purpose, it will be seen that one type of machine in which the invention may be incorporated has been designated in its entirety be reference numeral 10 and is known, as in one or more of the above prior patents. Mounted on the machine 10 are a pair of rubber tires 12 which permit the machine 10 to be easily transported and maneuvered. The wheels 12 are carried by an axle 14 which in turn passes through the rear portions of the base frame 16. Mounted to the frame 16 is an electrical motor 18. The machine 10 may alternately be powered by an internal combustion engine. The motor 18 is held in place by four mounting bolts 19 which pass through slots 20 in the frame 16. When the bolts 19 are loosened, the motor can be moved forward or backward on the frame 16 by reason of the slots 20 to adjust the tension in the drive belt 21. Covering the motor 18 and attached to the frame 16 is a cover shroud 22. The shroud 22 slides over the side walls 23 of the frame and is held in place by bolts 24 as can be seen in FIG. 1. Positioned on the front of the frame 16 is a nose weight 23. The weight is held in place by means of a releasable wire clip 26 which fastens the forward edge of the shroud 22 with the weight 25. The weight provides the necessary weight on the cutting edge 28, which will later be described.

The handle bar 29 comprises a pair of elongated tubular members 30 which are attached at their lower ends to the shroud 22, and at their upper ends are joined by tubular cross members 31 and 32. Hand grips 33 are used to handle and maneuver the machine 10.

Figure 3:
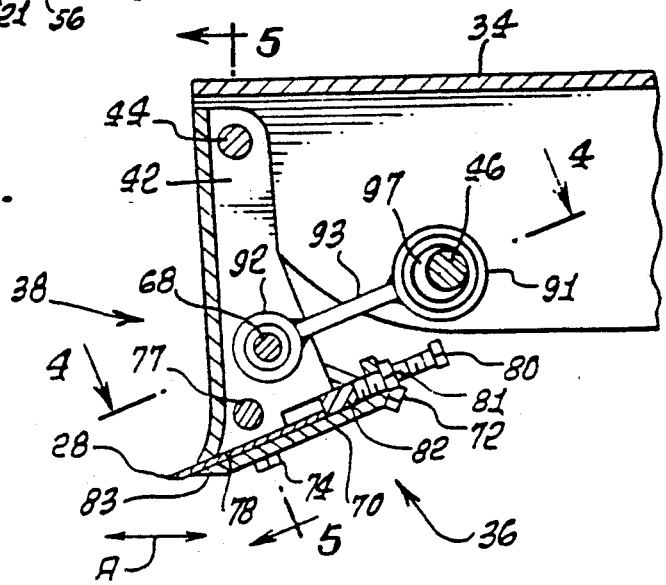
FIG. 3 is an enlarged elevation taken on lines 3–3 of FIG. 4.
Figure 4:
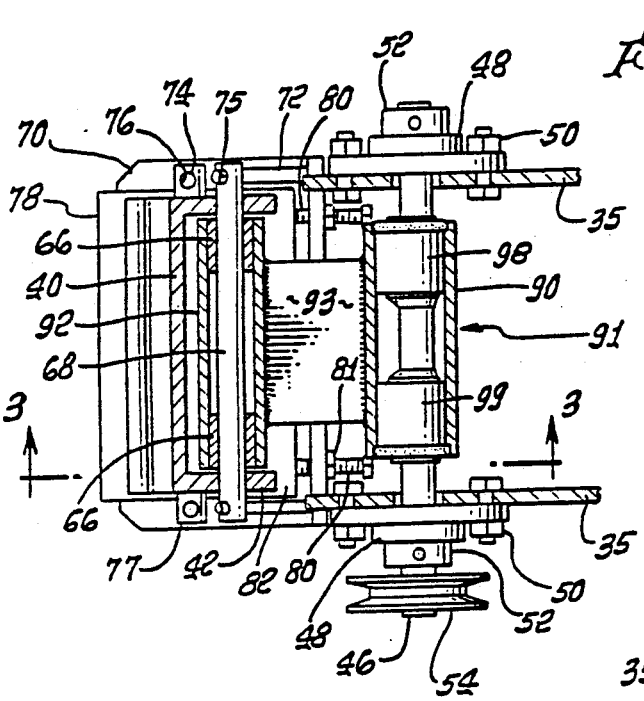
FIG. 4 is a section taken on lines 4–4 of FIG. 3.
Figure 5:
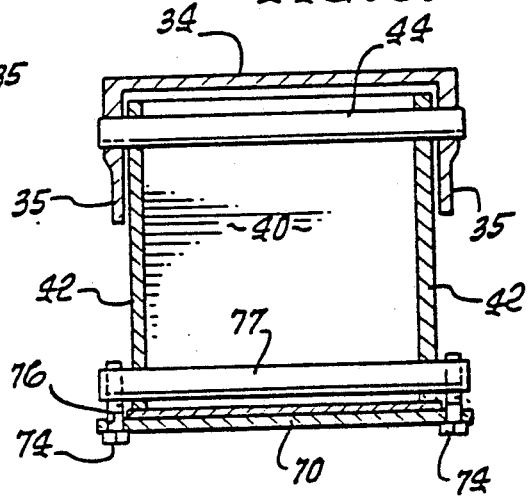
FIG. 5 is a section taken on lines 5–5 of FIG. 3.
Figure 6:
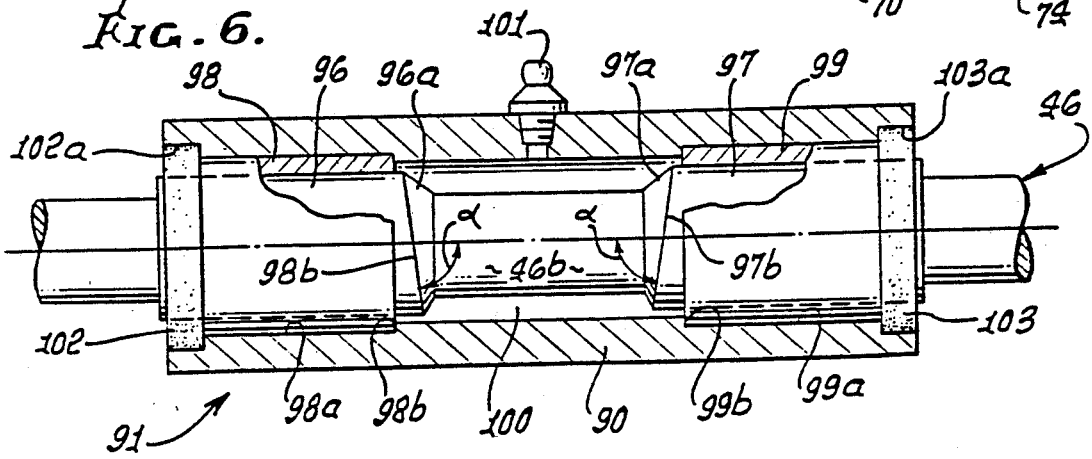
FIG. 6 is an enlarged section taken through connecting structure seen in FIG. 4.

FIGS. 3 through 5 show the cutter head subassembly 36 in detail. The frame 16 previously mentioned is substantially U-shaped with a horizontal web portion 34 and a pair of vertical flanges 35 as can best be seen in FIG. 5. At the forward end of the frame 16, positioned between the webs 35, is the cutting head 38. The head 38 is formed with a web 40 and a pair of flanges 42. The cutting head is pivotally mounted at the upper end to the frame 16 by a pin 44 which passes through both pairs of flanges 35 and 42 Passing through the pair of flanges 35 and journalled thereto is a rotatably mounted drive shaft 46 which is shown in FIGS. 4 and 6. The shaft 46 is journalled at its outer ends in a pair of roller bearings 48 which are in turn bolted to the frame flanges 35 by means of bolts 50. Retaining the cam shaft in the bearings 48 are a pair of locking sleeves 52 which are mounted on the shaft 46 immediately outward of the bearings 48. Keyed to one end of the shaft 46 is a sheave 54 adapted to carry a V-belt. Mounted on the shaft 56 of the motor 18 is a similar sheave 58 which lies in the same plane of rotation as sheave 54. The two sheaves 54 and 58 are connected by means of a rubber V-belt 21. The tension in the V-belt 21 may be adjusted as previously discussed.

Figure 7:
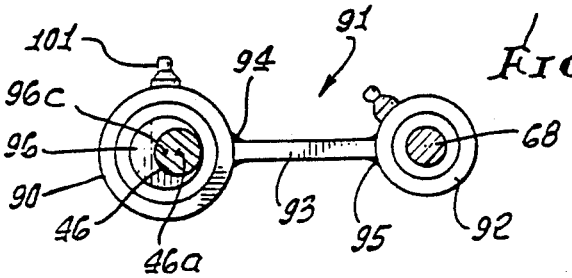
FIG. 7 is an end elevation view of the FIG. 6 connecting structure.

The shaft 46 extends within a first tubular part 90 of a connecting element 91, the latter also incorporating a second and smaller diameter tubular part 92. Those tubular parts may advantageously and inexpensively comprise steel pipe sections, interconnected by a steel plate 93 which is simply welded to outer side portions of the sections, as at 94 and 95. See FIG. 7. Accordingly, the cost of element 91 is minimized.

Shaft 46 carries two axially spaced eccentrics 96 and 97. See in FIG. 7 the axis 96*a* of eccentric 96 offset from the axis 46*a* of shaft 46. Each eccentric is cylindrical, to rotate within a bearing, such as a bushing, the two bushings indicated at 98 and 99 and received in counterbores 98*a* and 99*a* in the pipe section, and against step shoulders 98*b* and 99*b*. The large space 100 thus provided between the eccentrics provides a lubricant (grease) reservoir, for long lasting lubrication of the two bearings, as the shaft rotates and on the eccentrics oscillate the shaft section 90, and the element 91 back and forth, as will be described. Shaft section 46*b* extends between and interconnects the two eccentrics.

Note that the eccentrics have oppositely facing end portions or faces 96*a* and 97*a* which, due to their flaring eccentricity, tend to positively displace the grease as the eccentrics rotate. This serves to urge grease radially outwardly, and axially toward the bushings and the bearing surfaces of the eccentrics and bushings, for enhancement of lubrication. Note that faces 96*a* and 97*a* intersect the outer surfaces of the eccentrics in planes 96*b* and 97*b* that are at angles $\alpha$ relative to the shaft axis, angles $\alpha$ being less than 90°. Grease is introduced to space 100 via a grease fitting 101 in shaft 90, as shown.

Annular elastomeric seals 102 and 103 are located at opposite ends of the bushings, and pressed into the shaft counterbores 102*a* and 103*a*, as shown. Those seals exert pressure on the shaft eccentrics to prevent escape of grease.

At the opposite end of element 91 is a bearing shaft 68 journalled via bushings 66 to the pipe section 92. Shaft 68 is in turn mounted to cutting head 38. When shaft 46 is rotated, element 91 is oscillated back and forth to cause head 38 to move back and forth about the axis of pipe 44, as indicated by arrows A in FIG. 3.

At the lower extremities of the cutting head 38, the flanges 42 become wider to accommodate the cutting blade shoe 70. The shoe 70 is adjustably held against the cutting head by two pairs of bolts 72 and 74. The bolts 72 pass through openings 75 in the rear of the blade shoe 70 and are threaded into the ends of the connecting rod shaft 58. The bolts 74 pass through openings 76 and are threaded into the ends of shaft 77. The purpose of the blade shoe 70 is to rigidly hold the cutting blade 78 in its cutting position. Located on the back edge of the blade shoe 70 are a pair of adjusting bolts 80 and locking nuts 81 which allow for adjustment of the position of the blade stop 82 which in turn adjusts the amount of blade edge exposure. The front edge 83 of the blade shoe 70 is tapered to provide a maximum amount of rigidity to the cutting blade and yet permit a shallow angle of slope between the cutting blade 78 and the flooring surface being stripped.

Figure 8:
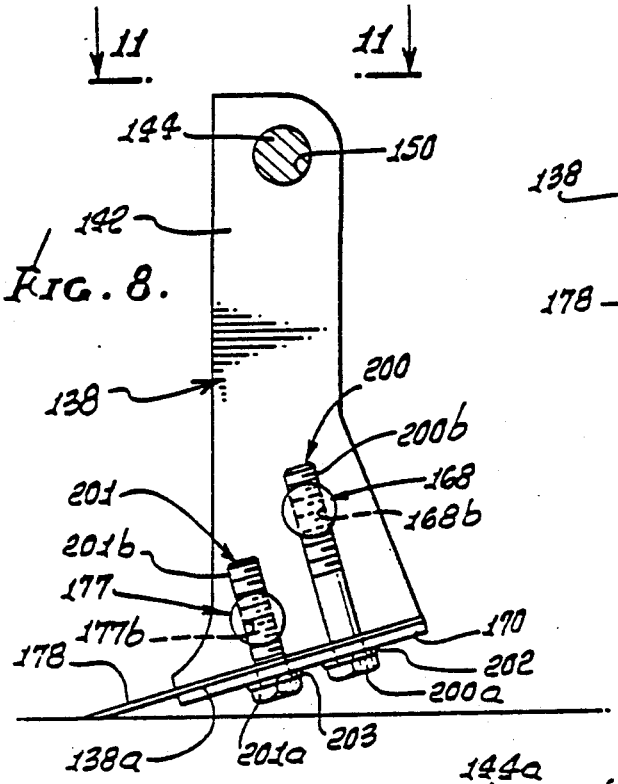
FIG. 8 is a side elevation.
Figure 10:
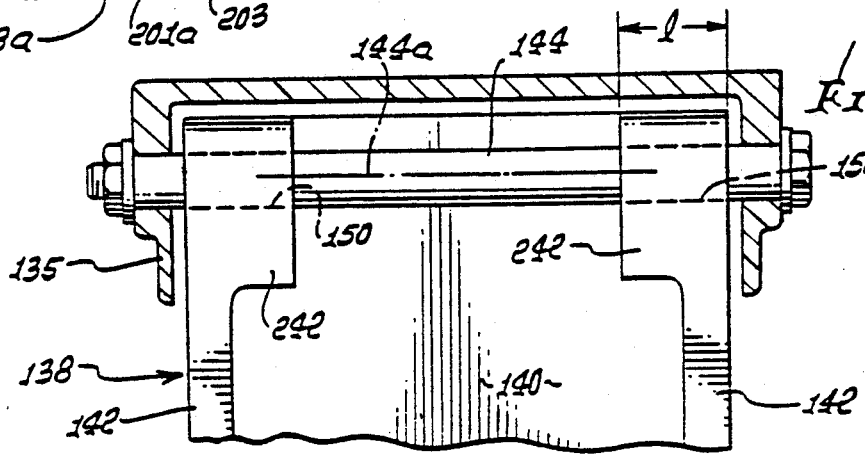
FIG. 10 is a fragmentary front elevation showing the head of FIG. 8.

FIGS. 8, 10 and 11 show a modified head 138 consisting of lightweight metal such as aluminum, or aluminum alloys, or magnesium, or magnesium alloys. The head has two elongated flanges 142 interconnected by a web 140. The flanges are locally thickened near upper ends of the flanges to define two widened lugs 242 that form widened bearing openings 150 for a pivot shaft 144. The latter is connected to the frame flanges 135 (corresponding to flanges 35 in FIG. 5). The bearing openings (and the lugs) have lengths "1" in excess of ¾ inch, and preferably are between ¾ and 1½ inches in length. As a result, destructive wear of the head metal surrounding the openings 150 is eliminated, and in particular for heavy duty operation where stripping forces are extensive.

The openings are sized to closely receive the pivot shaft 144, and define a common axis 144*a*. FIG. 11*a* shows a modification, with a steel tube 344 received in openings 150, and in turn receiving the shaft 144. Tube 344 helps distribute loading to insure against destructive wear of the lightweight metal lugs 242.

Figure 9:
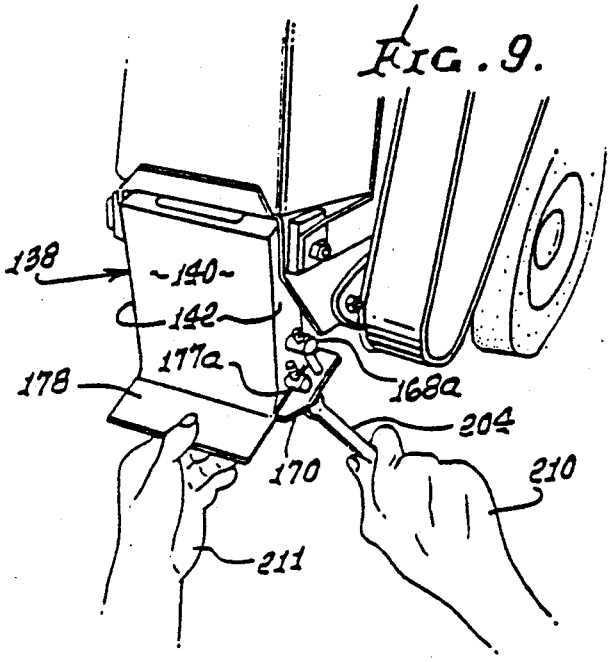
FIG. 9 is a perspective view.

FIGS. 8 and 9 also show the known use of the modified blade holder plate 170 attached to the head 138 at its bottom side 138*a*. Blade 178 is clamped against that side, by the plate. Two shafts, 177 and 168, extend parallel to the web 140 and through flanges 142 to provide shaft projections 177*a* and 168*a* at the exterior side of each flange. Two pairs of fasteners 200 and 201 extend in parallel relation through suitable openings in the holder plate and in the blade, at opposite ends of the shafts, respectively. The fasteners have heads 200*a* and 201*a* that clamp split washers 202 and 203 against the bottom of the holder plate. Also, the fasteners have threaded shanks 200*b* and 201*b* received in threaded engagement with threaded openings 177*b* and 168*b* in the shaft projections 177*a* and 168*a*. Accordingly, tightening of the blade in position as shown in FIG. 9 may be accomplished using one hand 210 only, i.e., by manipulation of the wrench 204 in grip engagement with the fastener heads, and the blade may be held and positioned by the other hand 211.

The operation of the stripping machine 10 varies with the type of floor being removed. The steeper the angle of the blade 78 with the floor, the deeper the blade will dig. The angle can be varied by lifting the wheels 12 off the floor. The angle can also be varied by extending the blade 78 further past the edge of the shoe 70. When removing a plywood or particle board floor, an extra long blade which extends an additional four inches or more past the edge of the shoe 70 has proven very useful. The longer the blade 78 is extended out of the shoe, the less the angle between the cutting blade and floor. The amount of weight applied to the cutting edge 28 is also variable depending upon the flooring being removed. The weight can be varied by the amount of pressure applied by the hands to the handle bar 29.

Generally, the machine best operates when the handle bar 29 is lifted up until the wheels are one-half inch off the floor. When an exceptionally tough flooring is being removed, a blade with teeth formed on the cutting edge has been found to be very effective.

In FIGS. 12–14, the modified blade holding or gripping apparatus 250 of the present invention includes two blade holder plates 251 and 252. These two plates extend in parallel plane and their inner surfaces 251*a* and 252*a* frictionally gripping opposite sides of a planar blade 253. The plates are metallic and typically consist of steel. The blade has a forward, sharpened edge 253*a*.

The upper blade is protectively held to the underside 138*c* of the lightweight metallic head 138 seen in FIG. 14 as by two bolts 254 projecting upwardly from plate 252. The bolt heads 254*a* are received in recesses 254*b* in plate 252; and the bolt upper portions are threaded at 254*c* for threaded reception in a laterally extending shaft 177, as referred to above in connection with FIG. 8.

The lower plate 251 is effectively carried by the head 138 at its lower end, and beneath plate 252, as referred to. Two posts 256 are carried by the lower plate as by post heads 256*a* received in recesses 256*b* formed in the underside of the lower plate, and the heads may be welded in position. The posts may comprise bolts, with threaded stems projecting upwardly, in parallel, to a level or levels at 256*c* forwardly of a plane 138*d* defined by the front of the head. Sleeves 257 are received on the posts as shown and project upwardly to levels 257*a* beneath washers 258 and nuts 259 on the posts. These upper levels are such that the nuts 259 can easily be tightened without wrench interference with the front of the head; and furthermore, the wrench is a considerable distance "d" above the blade forward edge for safety purposes when turning the wrench. The lower ends 256*d* of the sleeves engage a lateral shaft 260 located at the upper surface of the upper plate to distribute the loading exerted by the sleeves when the nuts are tightened. Such tightening transmits upward force in the posts and downward force to the sleeve, whereby the plates are caused to tightly grip the blade therebetween. Preferably, the distance "d", as shown, protectively spaces the nut wrench surfaces at least about two inches above blade level.

For further protection, each sleeve 257 may project about three inches or more above the upper plate 252, as seen in FIG. 15. In that view, a sleeve extension 256' extends above the sleeve 256 and washer, and is internally threaded at its lower end 256*a'* to attach to the upper threaded end of the post. The sleeve extension 256' thus defines a vertically elongated nut having hex wrench surfaces 256*b'* at its uppermost end, well above the blade, and above 256*a'* for enhanced safety and enhanced clearance from the front-end face of the head.

FIGS. 13 and 14 also show a blade stop shoulder 270 which engages the rearwardmost edge of the blade inserted between the plates. That shoulder is defined by a flange 270*a* integral with and depending from the rearwardmost end of the upper plate, as shown. Accordingly, the inserted blade is edgewise positioned between the lower extents of posts 256 and the rearward edge of the blade is positioned against the stop shoulder.

FIG. 14 also shows that the lower blade has a bevel 272 at the forwardmost underside thereof. The bevel tapers forwardly toward the underside of the blade, the cutting edge of which is spaced forwardly of the bevel. Accordingly, the lower plate cannot interfere with or butt up against the work being stripped as from a floor surface.

I claim:

1. For use in power-operated, floor stripping apparatus that includes a frame, a drive carried on the frame, wheels supporting the frame, a handle to guide the frame, and a cutter blade carried by a head which is pivotally mounted to the frame, the improvement comprising a) said head having a lower end to face toward the floor, b) upper and lower plates carried by said head at said lower end thereof to grip said cutter blade received therebetween, c) two posts carried by the lower plate to project upwardly through openings formed in the upper plate, and sleeves extending about the posts above the upper plate, the posts carrying exposed threads, d) and nut members threadably attached to the posts and having wrench surfaces spaced substantially above the level of the blade, the nuts tightenable to transmit upward force to the posts and downward force to the sleeves, whereby the plates are caused to grip the blade therebetween, the blade having a cutting edge directed forwardly, e) each nut member being elongated to project above the post to which it is attached, the nut member having internal threading proximate its lower end to threadably connect to said post, the nut member having tool grippable surfaces at its upper end to enable safe rotation of the nut member by the tool, said surfaces spaced above said internal threading, the nut member having overall length at least twice the nut member diameter.

2. The combination of claim 1 wherein the nut wrench surfaces are spaced at least about two inches above blade level.

3. The combination of claim 1 including a blade stop shoulder attached to one of the plates at the rearward end thereof.

4. The combination of claim 1 wherein the lower plate has a bevel at the forwardmost underside thereof, said bevel tapering forwardly and toward the blade underside.

5. For use in power-operated, floor stripping apparatus that includes a frame, a drive carried on the frame, wheels supporting the frame, a handle to guide the frame, and a cutter blade carried by a head which is pivotally mounted to the frame, the improvement comprising a) said head having a lower end to face toward the floor, b) upper and lower plates carried by said head at said lower end thereof to grip said cutter blade received therebetween, c) two posts carried by the lower plate to project upwardly through openings formed in the upper plate, and sleeves extending about the posts above the upper plate, the posts carrying exposed threads, d) and nut members threadably attached to the posts and having wrench surfaces spaced substantially above the level of the blade, the nuts tightenable to transmit upward force to the posts and downward force to the sleeves, whereby the plates are caused to grip the blade therebetween, the blade having a cutting edge directed forwardly, e) said head consisting of lightweight metal and having two flanges interconnected by a web, the flanges being locally thickened to substantial extent to define two lugs forming bearing openings for a pivot shaft connected to the frame, f) there being two shafts extending parallel to said head web and through said head flanges to provide shaft projections exteriorly of said flanges, and fasteners extending upwardly from said upper plate and having threaded shanks in threaded engagement with threaded openings in said shaft projections, said fasteners extending generally parallel to said posts.

6. The combination of claim 5 including g) a connecting element, having a first tubular part and a second tubular part, said parts having spaced, parallel axes, said second tubular part pivotally connected to the head, h) a drive shaft extending within said first tubular part, said shaft operatively connectible to the drive to be rotated thereby, i) said drive shaft carrying two axially spaced eccentrics to be rotated by the shaft, there being a lubricant receiving space located directly between said eccentrics, j) two annular bearings respectively carried by and within said first tubular part, said bearings respectively receiving said spaced eccentrics to oscillate said first tubular part, said head and said blade as said eccentrics are rotated by the shaft.

7. For use in power-operated, floor stripping apparatus that includes a frame, a drive carried on the frame, wheels supporting the frame, a handle to guide the frame, and a cutter blade carried by a head which is pivotally mounted to the frame, the improvement comprising a) said head having a lower end to face toward the floor, b) upper and lower plates carried by said head at said lower end thereof to grip said cutter blade received therebetween, c) two posts carried by the lower plate to project upwardly through openings formed in the upper plate, and sleeves extending about the posts above the upper plate, the posts carrying exposed threads, d) and nut members threadably attached to the posts and having wrench surfaces spaced substantially above the level of the blade, the nuts tightenable to transmit upward force to the posts and downward force to the sleeves, whereby the plates are caused to grip the blade therebetween, the blade having a cutting edge directed forwardly, e) and including a connecting element having a first tubular part and a second tubular part, said parts having spaced, parallel axes, said second tubular part pivotally connected to the head, and a drive shaft extending within said first tubular part, said shaft operatively connected to the drive to be rotated thereby, said drive shaft carrying two axially spaced eccentrics to be rotated by the drive shaft, there being a lubricant receiving space located directly between said eccentrics, and including said first tubular part and two annular bearings respectively carried by and within said first tubular part, said annular bearings respectively receiving said spaced eccentrics to oscillate said first tubular part, said head, said upper and lower plates, and said blade about said pivot axis as said eccentrics are rotated by the drive shaft.

8. The combination of claim 7 wherein said nut wrench surfaces are spaced at least about three inches above blade level.

9. The combination of claim 7 including a blade stop shoulder attached to one of the plates at the rearward end thereof.

10. The combination of claim 7 wherein the lower plate has a bevel at the forwardmost underside thereof, said bevel tapering forwardly.

11. The combination of claim 10 wherein said blade cutting edge is spaced forwardly of said bevel.

12. For use in power-operated, floor stripping apparatus that includes a frame, a drive carried on the frame, wheels supporting the frame, a handle to guide the frame, and a cutter blade carried by a head which is pivotally mounted to the frame, the improvement comprising a) said head having a lower end to face toward the floor, b) upper and lower plates carried by said head at said lower end thereof to grip said cutter blade received therebetween, c) two posts carried by the lower plate to project upwardly through openings formed in the upper plate, and sleeves extending about the posts above the upper plate, the posts carrying exposed threads, d) and nut members threadably attached to the posts and having wrench surfaces spaced substantially above the level of the blade, the nuts tightenable to transmit upward force to the posts and downward force to the sleeves, whereby the plates are caused to grip the blade therebetween, the blade having a cutting edge directed forwardly, e) each nut member being elongated to project above the post to which it is attached, the nut member having internal threading at its lower end to threadably connect to said post, and the nut member having wrench flats at its upper end, spaced above said internal threading, the nut member having overall length at least twice the nut member diameter.

* * * * *